US009310125B2

(12) United States Patent
Kim et al.

(10) Patent No.: US 9,310,125 B2
(45) Date of Patent: Apr. 12, 2016

(54) REFRIGERATOR AND DOOR POCKET OF REFRIGERATOR

(71) Applicant: SAMSUNG ELECTRONICS CO., LTD., Suwon-si, Gyeonggi-do (KR)

(72) Inventors: Jang Won Kim, Seoul (KR); Amitoj Singh, Harayna (IN); Seok Woo Choi, Seoul (KR); Jin Jeong, Yongin-si (KR); Hyung Yong Choi, Yongin-si (KR)

(73) Assignee: SAMSUNG ELECTRONICS CO., LTD., Suwon-Si (KR)

( * ) Notice: Subject to any disclaimer, the term of this patent is extended or adjusted under 35 U.S.C. 154(b) by 0 days.

(21) Appl. No.: 14/314,204

(22) Filed: Jun. 25, 2014

(65) Prior Publication Data

US 2015/0035426 A1 Feb. 5, 2015

(30) Foreign Application Priority Data

Aug. 1, 2013 (KR) ..... 10-2013-0091427

(51) Int. Cl.
*F25D 23/04* (2006.01)

(52) U.S. Cl.
CPC ..... *F25D 23/04* (2013.01)

(58) Field of Classification Search
CPC ..... F25D 23/04
USPC ..... 312/321.5, 348.3, 401, 405, 405.1; 62/377
See application file for complete search history.

(56) References Cited

U.S. PATENT DOCUMENTS

| | | | | |
|---|---|---|---|---|
| 3,133,427 | A * | 5/1964 | Petkwitz | F25D 11/02 312/290 |
| 4,084,866 | A * | 4/1978 | Hayashi | 312/321.5 |
| 5,445,452 | A * | 8/1995 | Kauffman | F25D 23/04 312/321.5 |
| 5,536,081 | A * | 7/1996 | Pokhis | 312/321.5 |
| 5,765,390 | A * | 6/1998 | Johnson | F25D 23/04 211/43 |
| 8,459,057 | B2 * | 6/2013 | Kim | F25C 5/185 222/146.6 |
| 2004/0188291 | A1 * | 9/2004 | Becke et al. | 206/320 |
| 2012/0286639 | A1 * | 11/2012 | Lee | F25D 23/025 312/405.1 |

FOREIGN PATENT DOCUMENTS

| | | |
|---|---|---|
| KR | 1999-0017209 | 5/1999 |
| KR | 10-0834107 | 5/2008 |
| KR | 10-2011-0112377 | 10/2011 |
| KR | 10-2012-0090687 | 8/2012 |

* cited by examiner

*Primary Examiner* — Matthew Ing
(74) *Attorney, Agent, or Firm* — Staas & Halsey LLP

(57) ABSTRACT

A refrigerator includes a body provided with a storage compartment having a front side opening, a door rotatably coupled by a coupling member to one side of the body to open/close the front side opening of the storage compartment; and at least one door pocket coupled to an inner side of the door in a way to have a storage space and provided with a first side surface and a second side surface, the second side surface provided at a side facing the storage compartment and the first side surface connected to the second side surface to be positioned adjacent to a side of the door that is open. The second side surface is formed at a position higher than a position of the first side surface to prevent cool air from leaking outside, and stored goods positioned in the storage space are withdrawn through the first side surface.

17 Claims, 9 Drawing Sheets

REFRIGERATOR AND DOOR POCKET OF REFRIGERATOR

CROSS-REFERENCE TO RELATED APPLICATIONS

This application claims the benefit of the Korean Patent Application No. 10-2013-0091427, filed on Aug. 1, 2013, in the Korean Intellectual Property Office, the disclosure of which is incorporated herein by reference.

BACKGROUND

1. Field

Embodiments of the present disclosure relate to a refrigerator and a door pocket for a refrigerator, and more particularly, to a refrigerator provided with a door pocket having a blocking wall separated from a storage comment, and a door pocket for a refrigerator.

2. Description of the Related Art

In general, a refrigerator represents an apparatus configured to store food at low temperature. The refrigerator includes a freezing compartment in which food is stored at relatively low temperature, and a refrigerating compartment in which food is stored at relatively high temperature.

In recent years, the definition of the refrigerator is being expanded as an apparatus configured to increase the convenience of a user beyond the definition of an apparatus simply configured to store food. Thus, various research is being conducted to increase the efficiency of the refrigerator to save energy.

A storage space of an inside the refrigerator includes a storage compartment having a refrigerating compartment and a freezing compartment, and a door pocket attached to an inner surface of a door. For a user to reach goods stored in the storage compartment or in the door pocket, the door is needed to be rotated to a predetermined angle or above. At this time, the cool air at an inside of the refrigerator is leaked to an outside, and thus a power loss may occur. Particularly, due to frequent opening/closing of the door to drink water during summer, the power loss may further be increased.

The stored goods being stored in the refrigerator may be different with respect to each other in terms of the duration of storage or the usage frequency, and thus a user reaching the stored goods in the same manner may be inefficient. Particularly, whenever a user consumes water or ice, which are the stored goods that are being frequently used during summer, the door is need to be open and closed to find the stored goods, and thus the accessibility is degraded.

SUMMARY

Therefore, it is an aspect of the present disclosure to provide a refrigerator configured in a way to reach food through a door pocket protrudedly installed at an open side of a door.

It is another aspect of the present disclosure to provide a refrigerator configured to prevent cool air at a storage compartment from leaking to an outside by including a blocking wall that is separated from the storage compartment.

Additional aspects of the disclosure will be set forth in part in the description which follows and, in part, will be apparent from the description, or may be learned by practice of the disclosure.

In accordance with an embodiment of the present disclosure, a refrigerator includes a body, a door and at least one door pocket. The body may be provided with a storage compartment having a front side opening. The door may rotatably coupled by a coupling member to one side of the body to open/close the front side opening of the storage compartment. The at least one door pocket may be coupled to an inner side of the door in a way to have a storage space and provided with a first side surface and a second side surface, the second side surface provided at a side facing the storage compartment and the first side surface connected to the second side surface to be positioned adjacent to a side of the door that is open. The second side surface may be formed at a position higher than a position of the first side surface to prevent cool air of the storage compartment from leaking to an outside, and stored goods positioned in the storage space may be withdrawn through the first side surface.

The door pocket may include a first pocket having the first side surface and the second side surface, and a second pocket disposed in parallel to the first pocket and positioned adjacent the coupling member.

The at least one door pocket may be provided in plurality thereof installed at the door in multiple steps, and a certain one of the first pockets of the plurality of door pockets may have the second side surface connected to a bottom surface of another one of the first pockets of the plurality of door pockets that is positioned at an upper side of the certain one first pocket.

The first pocket may include a third side surface connected to the second side surface and coupled to the door while being adjacent to the second pocket. The third side surface may be formed at a same height as the second side surface to form a blocking surface that separates a storage space of the first pocket from the storage compartment.

The blocking surface may include at least one ventilating port.

The first pocket may include a water purifier provided with a water container and a water supplying unit.

An upper portion of the water supplying unit may include an opening configured to receive water from the water container. The water container may be provided in a way to be detached from the first pocket. The cover unit to cover the opening unit may be provided so that a space at which the water container has been positioned is used as a shelf.

The first pocket and the second pocket may be insertedly fixed to the door.

The second pocket may include a receiving case configured to store storage goods in a closed space.

The refrigerator may further include a receiving door rotatably installed at one side of the receiving case to form a closed space.

The first pocket may include an ice storage container.

The first pocket may include an ice maker configured to generate and supply ice.

The coupling member may include a double hinge so that the door is rotated to expose the first pocket to an outside and that the door is rotated again to expose the storage compartment to an outside.

In accordance with another aspect of the present disclosure, a refrigerator includes a body, a door, a plurality of door pockets. The body may be provided with a storage compartment at an inside thereof. The door may have a first side configured to be separated from the body and allow the storage compartment to be exposed to an outside and a second side positioned at an opposite side of the first side and rotatably coupled to the body. The plurality of door pockets may be coupled to an inner side of the door in multiple steps while being connected from the first side to the second side. The door pocket may include a first pocket positioned adjacent to the first side and a second pocket positioned adjacent to the second side, the first pocket protruding toward the storage compartment by a width larger than a width by which the second pocket protrudes toward the storage compartment.

The first pocket may include a first side surface positioned adjacent to the first side so as to be coupled to the door. The first side surface may be provided in a curved shape so that the first side surface is exposed to an outside without restriction according to rotation of the door.

The first pocket may include a second side surface connected to the first side surface and formed at a side facing the storage compartment, and the third side surface connected to the second side surface and positioned adjacent to the second pocket. The second side surface and the third side surface may be formed at a height higher than a height of the first side surface so that cool air of the storage compartment is prevented from leaking to an outside.

One of the first pockets of the plurality of door pockets that is provided at a highest position of the door may have the second side surface and the third side surface formed to an upper surface of the storage compartment.

The refrigerator may further include a shelf and a storage container that are provided at an inside the storage compartment. To correspond to a shape of the door pocket, one side of each of the shelf and the storage container facing the first pocket may have a width smaller than a width of another side of each of the shelf and the storage container facing the second pocket.

In accordance with another aspect of the present disclosure, a door pocket of a refrigerator that is fixed to an inner side surface of a door to store storage goods includes a first pocket and a second pocket. The first pocket may be positioned adjacent to a first side of the door that is separated from the body as the door is rotated. The second pocket may be positioned adjacent to a second side of the door that is coupled to the body. The first pocket may protrude from an inner side surface of the door by a width larger than a width by which the second pocket protrudes from the inner side surface of the door so as to have a storage space which is accessible when the door is partially open.

The storage space may be installed in a way to easily withdraw storage goods stored in the storage space even when the door is partially open As is apparent from the above, a user may easily and quickly reach stored goods through a door pocket protrudedly provided at an open side of a door.

In addition, the operation efficiency of a refrigerator may be increased as the loss of cool air at an inside the refrigerator is prevented by use of a blocking wall provided at a door pocket having a storage space.

BRIEF DESCRIPTION OF THE DRAWINGS

These and/or other aspects of the disclosure will become apparent and more readily appreciated from the following description of the embodiments, taken in conjunction with the accompanying drawings of which.

DETAILED DESCRIPTION

Figure 1:
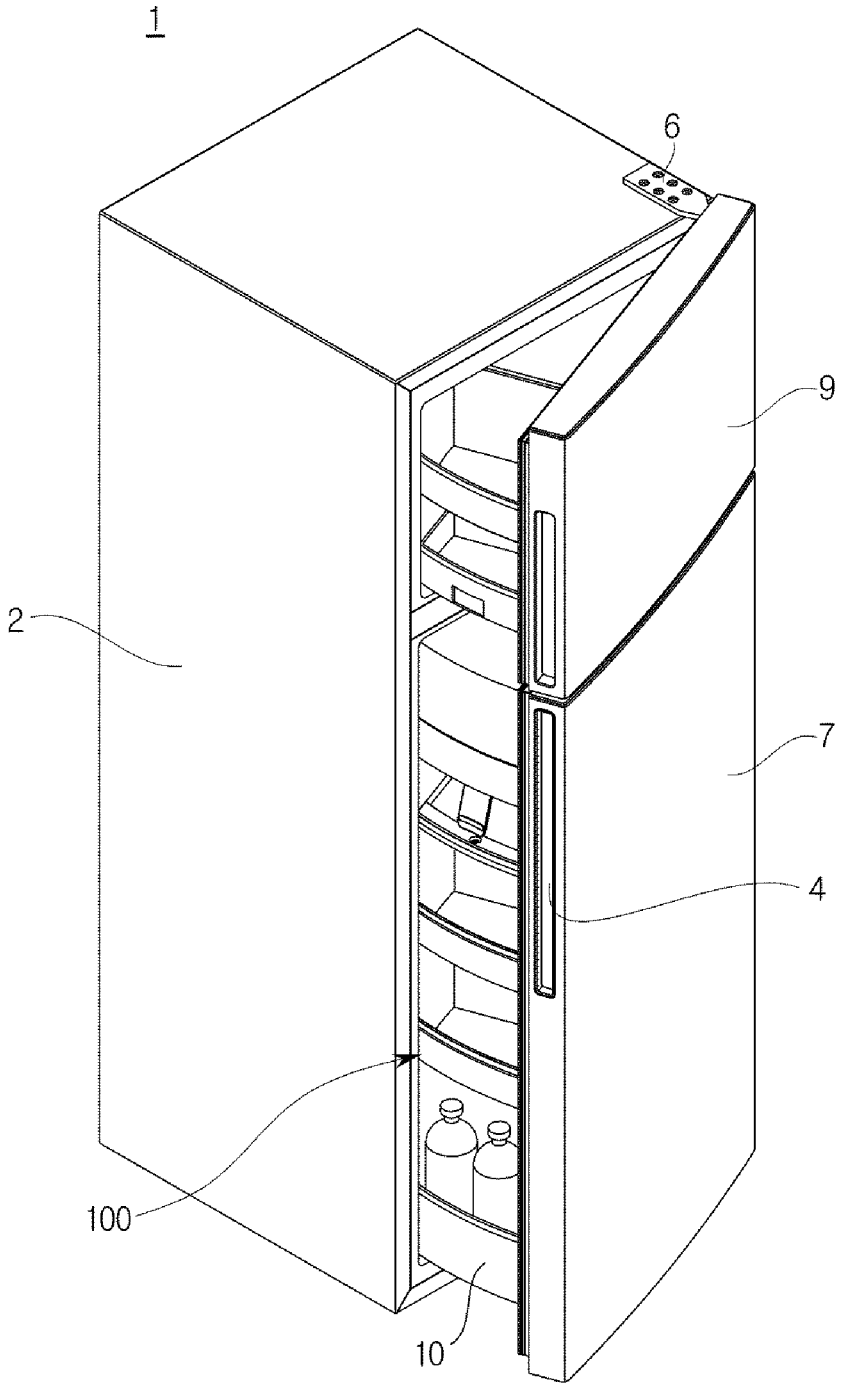
FIG. 1 is a drawing illustrating a refrigerator in accordance with one embodiment of the present disclosure.

Reference will now be made in detail to the embodiments of the present disclosure, examples of which are illustrated in the accompanying drawings, wherein like reference numerals refer to like elements throughout.

Figure 2:
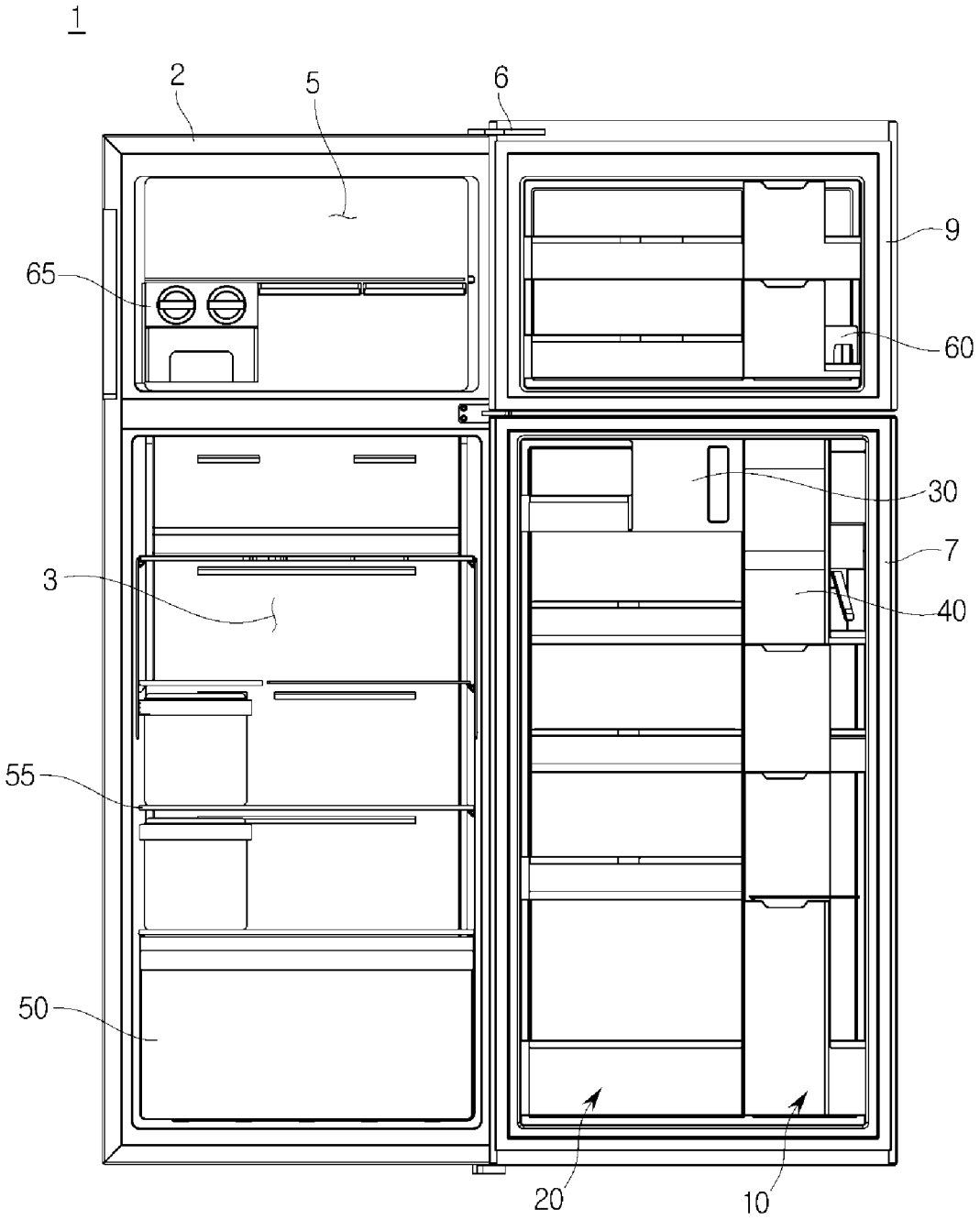
FIG. 2 is a drawing illustrating inner parts of the refrigerator in accordance with one embodiment of the present disclosure.

FIG. 1 is a drawing illustrating a refrigerator 1 in accordance with one embodiment of the present disclosure, and FIG. 2 is a drawing illustrating inner pars of the refrigerator 1 in accordance with one embodiment of the present disclosure.

The refrigerator 1 includes a body 2 forming an exterior appearance of the refrigerator 1, storage compartments 3 and 5 provided at an inside the body 2 to store food, and doors 7 and 9 configured to shut off the storage compartments 3 and 5 from an outside.

The storage compartments 3 and 5 may include a refrigerating compartment 3 to store stored goods in a refrigerated manner and a freezing compartment 5 to store stored goods in a frozen manner, the refrigerating compartment 3 and the freezing compartment 5 divided between each other at an upper side and a lower side while interposing a middle partition therebetween.

The refrigerating compartment 3 and the freezing compartment 5 each is provided with an opening at a front surface thereof so that a user may insert or withdraw food. At each of the refrigerating compartment 3 and the freezing compartment 5, a shelf 55 is provided so that the inside space thereof may be composed in multiple steps to easily store stored goods.

The doors 7 and 9 may include a refrigerating compartment door 7 and a freezing compartment door 9 respectively provided at the front surfaces of the doors 7 and 9. The refrigerating compartment door 7 and the freezing compartment door 9 each is rotatably coupled to the body 2 by a coupling member 6, so that the opening of the front surface of each of the refrigerating compartment 3 and the freezing compartment 5 may be open/closed while being rotated to the left side and the right side. A portion of each of the doors 7 and 9 being separated from the body 2 to expose the storage compartments 3 and 5 respectively is referred to as a first side, and a portion of each of the doors 7 and 9 positioned at an opposite side of the first side and rotatably coupled to the body 2 is referred to as a second side.

A door pocket 100 capable of storing stored goods is provided in lengthways in a way to be connected from the first side to the second side at an inner side surface of each of the doors 7 and 9, and may be provided in plurality in multiple steps from a lower portion to an upper portion of each of the doors 7 and 9. The door pocket 100 may include a first pocket 10 positioned adjacent to the first side of each of the doors 7 and 9, and a second pocket 20 positioned adjacent to the second side. That is, the first pocket 10 is positioned adjacent to a hand grip 4 of each of the doors 7 and 9, and the second pocket 20 may be positioned adjacent to the coupling member 6. The first pocket 10 and the second pocket 20 are positioned in line with each other in a transverse direction, and each of the first pocket 10 and the second pocket 20 may be provided in plurality to form multiple steps.

The door pocket 100 is exposed to an outside as the doors 7 and 9 are rotated to be separated from the body 2, and a user may reach the stored goods stored at the door pocket 100. As illustrated on FIG. 1, in a case when each of the doors 7 and 9 is partially open, the first pocket 10 is exposed to an outside, and stored goods may be withdrawn from the storage space of the first pocket 10.

As illustrated on FIG. 2, the first pocket 10 and the second pocket 20 may be provided in various shapes. The first pocket 10 may include a water purifier 40 provided at the refrigerating compartment door 7, and an ice storage container 60 provided at the freezing compartment door 9 for a user to conveniently receive water or ice. The second pocket 20 may include a receiving case 30 that is closed to store dairy product. The refrigerating compartment 3 may include a storage container 50 configured to store mainly vegetables or fruits while positioned at a lower portion, and the freezing compartment 5 may include an ice maker 65 configured to generate and store ice.

The refrigerating compartment door 7 and the freezing compartment door 9 each configured to open/close the refrigerating compartment 3 and the freezing compartment 5 are hinge-coupled to one side of the body 2. As illustrated on FIG. 1, the coupling member 6 may be provided in the form of a double hinge, so that the doors 7 and 9 are partially open to expose the first pocket 10 to an outside as the doors 7 and 9 are rotated, and that the doors 7 and 9 are rotated again to expose the storage compartments 3 and 5 to an outside.

Figure 3:
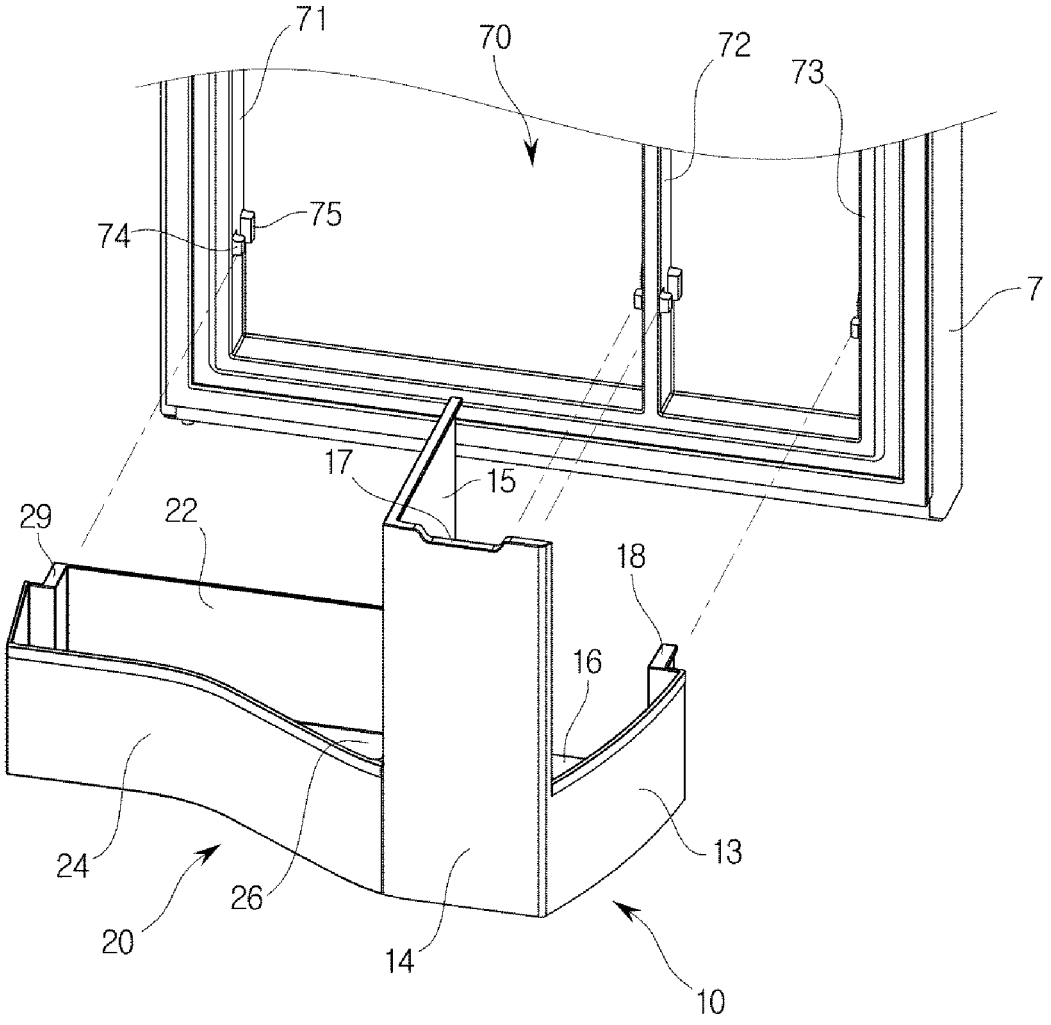
FIG. 3 is a drawing illustrating a coupling of a first pocket and a second pocket to a door of the refrigerator in accordance with one embodiment of the present disclosure.
Figure 4:
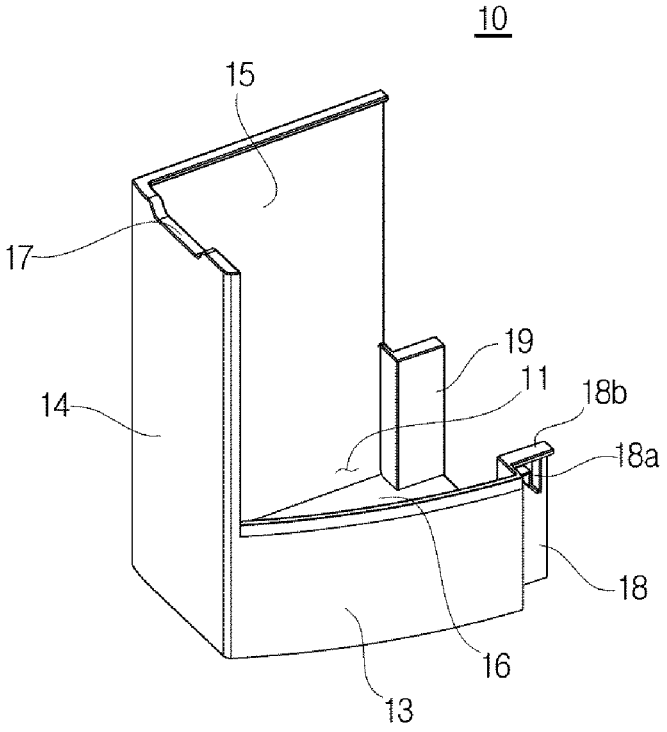
FIG. 4 is a drawing illustrating the first pocket of the refrigerator in accordance with one embodiment of the present disclosure.
Figure 5:
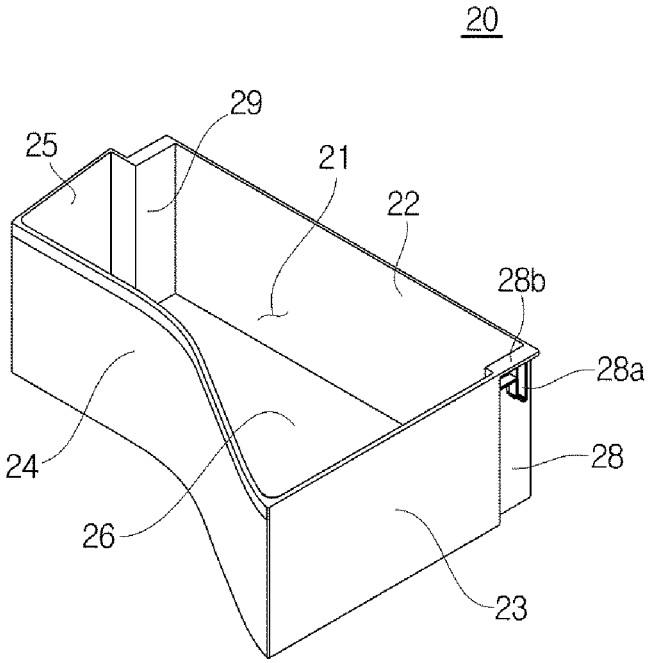
FIG. 5 is a drawing illustrating the second pocket of the refrigerator in accordance with one embodiment of the present disclosure.

FIG. 3 is a drawing illustrating a coupling of the first pocket 10 and the second pocket 20 to the doors 7 and 9 of the refrigerator 1 in accordance with one embodiment of the present disclosure, FIG. 4 is a drawing illustrating the first pocket 10 of the refrigerator 1 in accordance with one embodiment of the present disclosure, and FIG. 5 is a drawing illustrating the second pocket 20 of the refrigerator 1 in accordance with one embodiment of the present disclosure.

One side of each of the first pocket 10 and the second pocket 20 is coupled to an inner side surface 70 of each of the doors 7 and 9 in a protruded manner toward the direction of the storage compartments 3 and 5, respectively, and may include a storage space at an inside each of the first pocket 10 and the second pocket 20. The first pocket 10 may be protrudedly provided toward the direction of each of the storage compartments 3 and 5 while having a larger width than the width of the second pocket 20. Thus, a bottom surface 16 of the first pocket 10 may be provided in the approximate shape of a quadrate, and a bottom surface 26 of the second pocket 20 may be provided in the shape of being connected in a transverse direction.

The first pocket 10 and the second pocket 20 may be insertedly fixed into the doors 7 and 9 in a parallel manner. The inner side surface 70 of each of the doors 7 and 9 may include an outer side rib 73 provided at the first side, an inner side rib 71 provided at the second side, and a central rib 72 positioned in between the outer side rib 73 and the inner side rib 71. The outer side rib 73, the inner side rib 71, and the central rib 72 are formed lengthwise along the inner side surface 70, and may include at least one set of protrusions 74 and 75. The central rib 72 is positioned in between the first pocket 10 and the second pocket 20, and may include the protrusions 74 and 75 at both sides thereof that are formed toward the outer side rib 73 and the inner side rib 71, respectively. Each of the outer side rib 73 and the inner side rib 71 may include the protrusions 74 and 75 formed toward the direction of the central rib 72.

The protrusions 74 and 75 may include a first protrusion 74 and a second protrusion 75 positioned at an inner side of the first protrusion 74 and spaced apart by a certain distance from the first protrusion 74. The second protrusion 75 may be provided to be larger than the first protrusion 74. Grooves that correspond to the protrusions 74 and 75 may be provided at both sides of one side surface of the first pocket 10 and the second pocket 20, the one side surface coupled to the doors 7 and 9. Each of protrusions 18*a* and 28*a* illustrated on FIG. 4 and FIG. 5 is protruded to an outside to form grooves at both sides thereof that may be coupled to the first protrusion 74 and the second protrusion 75, respectively. Each of the protrusions 18*a* and 28*a* is provided in a bent shape to form a small sized groove, to which the first protrusion 74 is coupled, while forming an opposite groove, to which the second protrusion 75 having a relatively large size is coupled. As fixing parts 18*b* and 28*b* provided at upper portions of the grooves prevent the protrusions 74 and 75 from slipped to an upper portion, each of the doors 7 and 9 may be stably coupled to the first pocket 10 and the second pocket 20. Thus, the first pocket 10 is fixed in between the outer side rib 73 and the central rib 72, and the second pocket 20 may be fixed in between the central rib 72 and the inner side rib 71.

As illustrated on FIG. 4, the first pocket 10 may include a first side surface 13 positioned adjacent to the first side, a second side surface 14 connected to the first side surface 13 and provided toward the direction of each of the storage compartments 3 and 5, a third side surface 15 connected to the second side surface 14 and formed adjacent to the second pocket 20, and a bottom surface 16. The first side surface 13, the second side surface 14, the third side surface 15, and the bottom surface 16 may be transparently provided for a user to easily identify stored goods.

The bottom surface 16 may be provided in a flat manner so that stored goods having a long length thereof, such as a water bottle, may be stored at a storage space 11 while maintaining a balance. As previously described, the first pocket 10 is relatively protruded toward the direction of each of the storage compartments 3 and 5 when compared to the second pocket 20, and accordingly, the bottom surface 16 may be provided in the approximate shape of a quadrate. As the bottom surface 16 is surrounded by each of the sides 13, 14, and 15 while one side of the first pocket 10 is attached to the doors 7 and 9, the storage space 11 may be provided.

The first side surface 13 is provided at an outer side of e each of the doors 7 and 9 while formed at a height lower than that of the second side surface 14 and the third side surface 15, so that stored goods may be withdrawn. As a user separates the doors 7 and 9 from the body 2 by pulling the doors 7 and 9, the first pocket 10 is exposed to an outside, and then the user may be able to withdraw the stored goods positioned at the storage space 11 through the first side surface 13. The first side surface 13 may be provided in the shape of a curve so that, as the doors 7 and 9 are rotated, the first side surface 13 may be exposed to an outside without inconvenience in usage.

The second side surface 14 and the third side surface 15 may be formed at heights higher than the first side surface 13, so that the cool air of the storage compartments 3 and 5 is not leaked to an outside even in the case when the first pocket 10 is exposed to an outside while the doors 7 and 9 are rotated. The second side surface 14 and the third side surface 15 may be formed at a same height, and may be together referred to as blocking surfaces 14 and 15 configured to separate the storage compartments 3 and 5 from the storage space 11.

The blocking surfaces 14 and 15 as such may be provided in lengthways while having a length corresponding to the distance between each of the plurality of first pockets 10. The second side surface 14 ad the third side surface 15 of a certain one of the plurality of first pockets 10 installed in multiple steps may be formed at a higher level up to the bottom surface 16 of another first pocket 10 positioned at an upper side of the certain first pocket 10. The second side surface 14 and the third side surface 15 of the first pocket 10 positioned at the highest portion of each of the doors 7 and 9 may be formed up to the upper surface of each of the storage compartments 3 and 5. Thus, the blocking surfaces 14 and 15 of each of the plurality of first pockets 10 provided in multiple steps are connected in a longitudinal direction of the refrigerator 1, and may prevent the cool air of the storage compartments 3 and 5 from being leaked to an outside.

The blocking surfaces 14 and 15 may include at least one ventilating port 17. The stored goods positioned at the storage space 11 of the first pocket 10 may receive cool air of the storage compartments 3 and 5 through the ventilating port 17. On FIG. 3, the ventilating port 17 is provided in the concave-convex shape at an upper portion of the third side surface 14, and cool air may pass therethrough.

At one side of each of the first side surface 13 and the second side surface 15, ridges 18 and 19 extended toward the direction of the doors 7 and 9 may be provided so that the first pocket 10 may be coupled to the doors 7 and 9. The first ridge 18 is provided to be connected to the first side surface 13, and the second protrusion unit 19 may be formed at a lower portion of the third side surface 15 alongside the height of the first side surface 13. The ridges 18 and 19 each is protruded toward the direction of the inside space 11, and the first ridge 18 and the second ridge 19 may be more adjacently positioned than the first side surface 13 and the third side surface 15. As exemplified by protrusion 18*a*, at an upper portion of each of the ridges 18 and 19, protrusions are bentedly protruded toward an outside direction to form grooves on both sides thereof such that the grooves may be coupled to the protrusions 74 and 75 of the doors 7 and 9.

As illustrated on FIG. 5, the second pocket 20 may include a first side surface 23 positioned adjacent to the first pocket 10, a second side surface 24 connected to the first side surface 23 and formed at a side facing the storage compartments 3 and 5, a third side surface 25 connected to the second side surface 24 and positioned at an opposite side of the first side surface 23, and a bottom surface 26. In addition, the second pocket 20 includes a fourth side surface 22 provided with both sides thereof coupled to the first side surface 23 and the third side surface 25 to make contact with each of the doors 7 and 9, so that the second pocket 20 may be stably coupled to each of the doors 7 and 9.

The four units of the side surfaces 22, 23, 24, and 25 are provided at a same height with respect to each other, so that a user may be able to withdraw stored goods. The bottom surface 26 may be provided in a flat manner so that stored goods may be stored at a storage space 21 in a stable manner. The first side surface 23 is positioned in parallel to the third side surface 15 of the first pocket 10, and may be formed while having the same width as the third side surface 15 of the first pocket 10. The second pocket 20 is protruded toward each of the storage compartments 3 and 5 while having a smaller width when compared to the first pocket 10, and the second side surface 24 may be formed in the shape of a curve due to the difference of the width of the first side surface 23 and the width of the third side surface 25.

Coupling parts 28 and 29 may be provided at an edge at which the fourth side surface 22 makes contact with the first side surface 23 and at an edge at which the fourth side surface 22 makes contact with the third side surface 25, respectively, so as to be coupled to the doors 7 and 9. Since the coupling parts 28 and 29 each is protruded toward the storage space 21, the fourth side surface 22 has a width smaller than that of the second side surface 24 corresponding to the fourth side surface 22. As exemplified by bent protrusion 28*a*, at an upper portion of each of the coupling parts 28 and 29, bent protrusions are protruded outside while each forming grooves at both sides thereof, so that the protrusions may be coupled to the doors 7 and 9.

Figure 6:
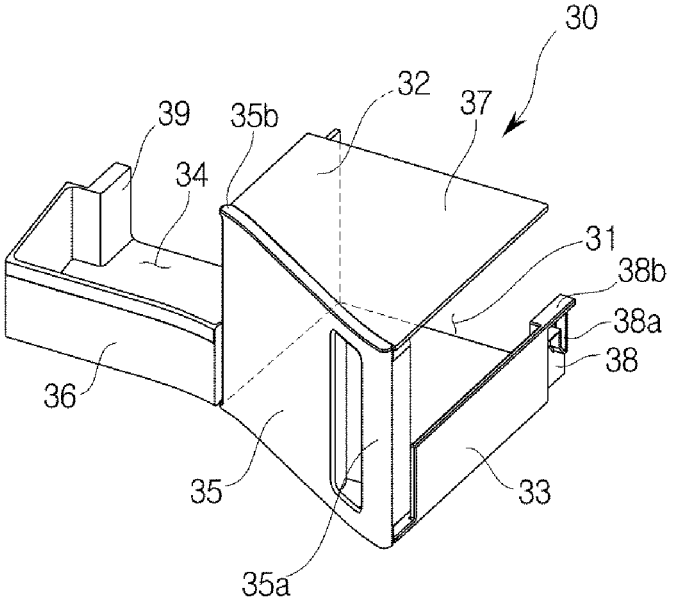
FIG. 6 is a drawing illustrating a receiving case of the refrigerator in accordance with one embodiment of the present disclosure.

FIG. 6 is a drawing illustrating a receiving case 30 of the refrigerator 1 in accordance with one embodiment of the present disclosure.

The second pocket 20 may include the receiving case 30 configured to store stored goods in a closed space. As for the stored goods being stored in the refrigerator 1, several types of the stored goods may be present, and among the several types of the stored goods, the stored goods which are needed to be controlled in terms of humidity may be present. As to satisfy the purpose as the above, the second pocket 20 may be provided in the form of the receiving case 30 forming a closed space 31.

The receiving case 30 may include a sidewall 33 facing the first pocket 10, a partition wall 32 positioned at a central portion of the bottom surface, a receiving door 35 rotatably provided, and an upper surface 37, thereby forming the closed space 31 while coupled to the doors 7 and 9. At an edge at which the partition wall 32 and the receiving door 35 meet each other, a fixing part 35*b* allowing the receiving door 35 to be rotated may be provided. A hand grip 35*a* may be attached at an opposite side of the fixing part 35*b* so that the receiving door 35 may be easily open and closed.

At an opposite side of the closed space 31 divided by the partition wall 32, an outer wall 36 may be formed to form a general storage space 34. The receiving case 30 and the storage space 34 connected to the receiving case 30 together include coupling parts 38 and 39 positioned at both sides thereof while being formed toward the direction of the doors 7 and 9, and may be coupled to the doors 7 and 9 through the coupling parts 38 and 39. As exemplified by bent protrusion 38*a* and fixing part 28*b*, each of the coupling parts 38 and 39 may include bent protrusions and fixing parts.

Figure 7:
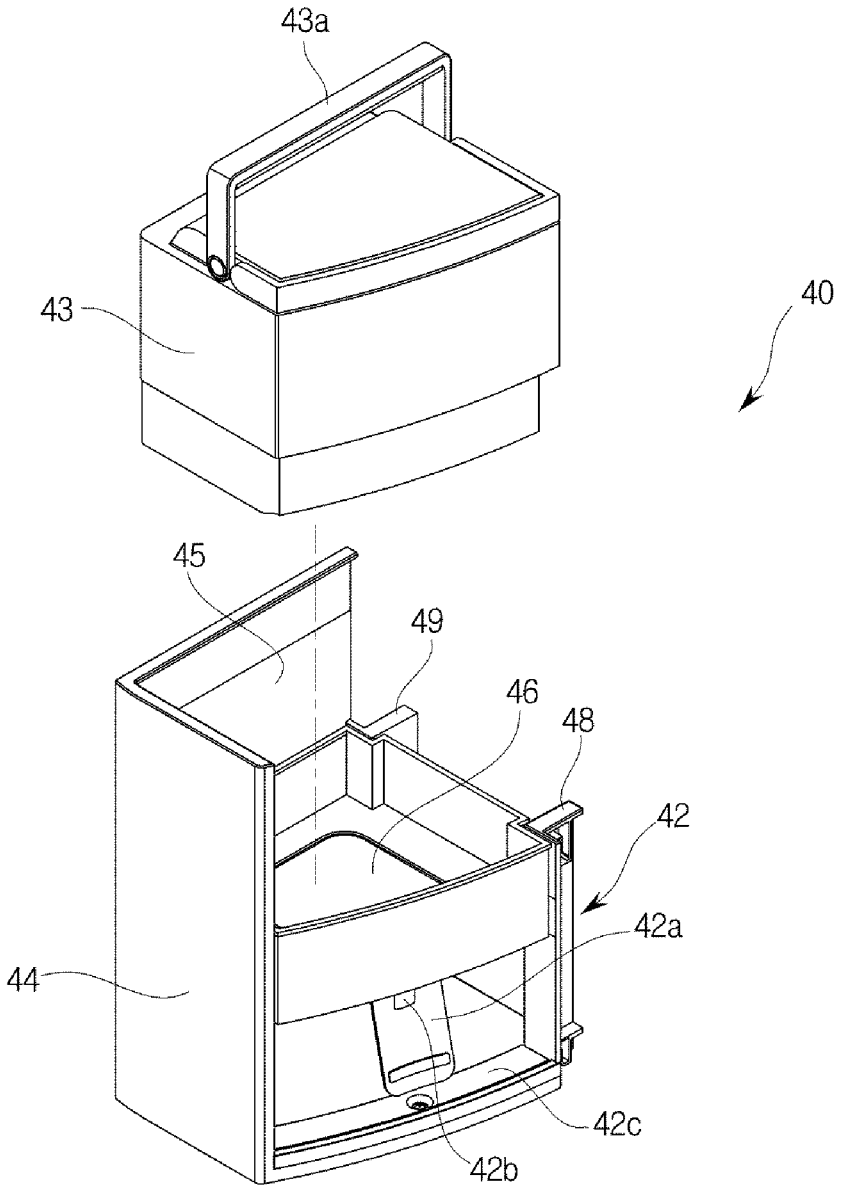
FIG. 7 is a drawing illustrating a water purifier of the refrigerator in accordance with one embodiment of the present disclosure.

FIG. 7 is a drawing illustrating a water purifier 40 of the refrigerator 1 in accordance with one embodiment of the present disclosure.

The first pocket 10 may include the water purifier 40 provided with a water container 43 and a water supplying unit 42. A lower portion of the water container 43 is settled at an upper portion of the water supplying unit 42, and may be stably installed while being surrounded by two units of side walls 44 and 45. The water supplying unit 42 as well may be settled at the side walls 44 and 45 and at the bottom surface to be stably installed. The first pocket 10 may be coupled to the doors 7 and 9 through coupling units 48 and 49 provided at the one side wall 45 and at the bottom surface.

The water container 43 may be detachably provided at the water supplying unit 42 so that a user may store water in the water container 43 or clean the water container 43. At an upper portion of the water container 43, a hand grip 43*a* may be provided to provide convenience in moving the water container 43. In addition, at a lower portion of the water container 43, a water supplying port configured to supply water stored at the water supplying unit 43 may be provided.

An upper side of the water supplying unit 42 is provided in a flat manner so that the water container 43 may be mounted on the upper side of the water supplying unit 42, and may include a second opening corresponding to a first opening that is positioned at a lower portion of the water container 43 so that water may be supplied from the water container 43. The first opening is protruded toward a lower side from a lower portion of the water container 43 so that the supply of the water may take place in a smooth manner, and the second opening may be correspondingly provided in a depressed manner from an upper side of the water supplying unit 42 toward a lower side. At an upper surface of the water supplying unit 42, a push-in device 42*a* for a user to use to selectively receive water and a supplying port 42*b* positioned at an upper portion of the push-in device 42*a* through which water is run may be positioned. At a lower portion of the upper surface, a support panel 42*c* is provided so that a user may be conveniently provided with water.

In a case when the water purifier 40 is not being used, the water container 43 may be separated, and an upper portion of the water supplying unit 42 may be used as a shelf. By blocking an opening by use of a cover 46 to store stored goods, the upper portion of the water supplying unit 42 may be provided in a flat manner. The cover 46 may be provided in the shape of a square so that the cover 46 may be easily separated by pressing a certain one corner of the cover 46.

Figure 8:
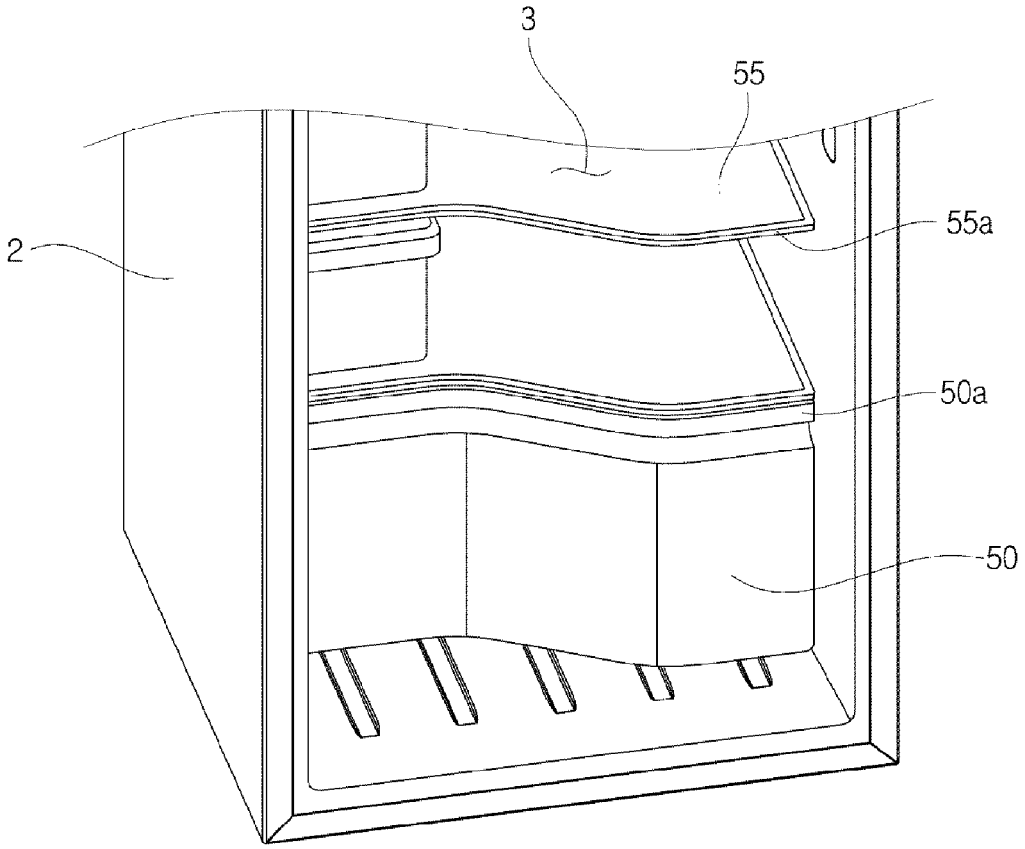
FIG. 8 is a drawing illustrating a shelf and a storage container of the refrigerator in accordance with one embodiment of the present disclosure.

FIG. 8 is a drawing illustrating the shelf 55 and the storage container 50 of the refrigerator 1 in accordance with one embodiment of the present disclosure.

At each of the storage compartments 3 and 5 of the body 2, the shelf 55 may be provided in plurality to organize stored goods. One side 55*a* of the shelf 55 that faces the door pocket 10 may be provided with the shape of a curve, as one side of the door pocket 10 is protruded. In a case when the doors 7 and 9 are coupled to the body 2, the shelf 55 and the door pocket 10 are faced each other to form an inside space of the body 2, and thus the shelf 55 and the door pocket 10 may be provided in a corresponding structure with respect to each other. The one side 55*a* of the shelf 55 has an outer side portion at which the protruded first pocket 10 is positioned may be formed in a concave manner.

At a lower portion of the refrigerating compartment 3, the storage container 50 may be provided to store mainly vegetables or fruits. One side of the storage container 50 as well may be formed in a concave manner to correspond to the shape of the door pocket 10. The storage container 50 includes a hand grip 50*a* so that a user may be able to separate the storage container 50 by use of the hand grip 50*a*, and thus a front surface 50*b* of the storage container 50 may be provided with an outer side portion thereof formed in a concave manner.

That is, each of the shelf 55 and the storage container 50, by corresponding to the shape of the door pocket 10, may be provided with one side thereof formed in a way that the one side facing the door pocket 10 is provided with a smaller width than the width of one side thereof that is faced with the second pocket 20.

Figure 9:
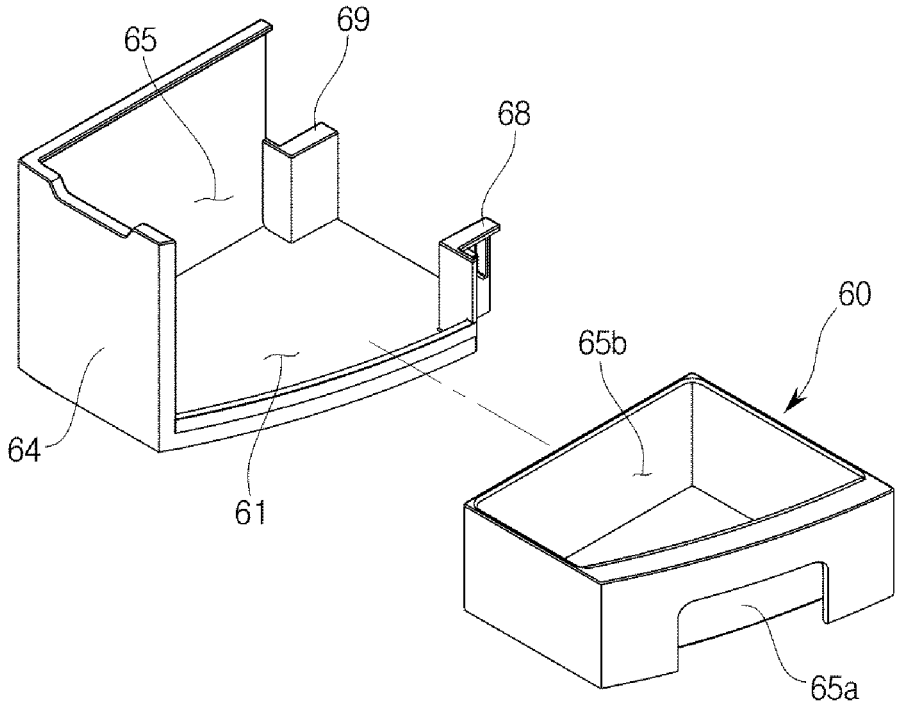
FIG. 9 is a drawing illustrating an ice storage container of the refrigerator in accordance with one embodiment of the present disclosure.

FIG. 9 is a drawing illustrating an ice storage container 60 of the refrigerator 1 in accordance with one embodiment of the present disclosure.

The first pocket 10 positioned at the freezing compartment 5 may include the ice storage container 60 configured to store ice. Ice is referred to as the stored goods that is highly frequently used among the stored goods that are being stored in the freezing compartment 5, and the cool air of the freezing compartment 5 may be leaked as the door 9 is open whenever the ice is being used. Thus, as the door 9 is rotated while having the ice storage container 60 in the door pocket 10, the leakage of cool air may be prevented through blocking walls 64 and 65.

One side of the first pocket 10 is provided with an opening so that the ice storage container 60 may be inserted into an inside space 61, and another sidewall 64 may be provided at a higher level to accommodate the ice storage container 60. The ice storage container 60 may be provided with the shape of a box having an upper portion thereof open so that ice may be stored at an inside 65*b*. At a front surface of the ice storage container 60, a hand grip 65*a* may be formed for a user to easily move the ice storage container 60.

The inside space 61 in which the ice storage container 60 is accommodated includes the coupling units 68 and 69 at one side thereof, and thus may be coupled to the door 9. In addition, the first pocket 10, in place of the ice storage container 60 to store only ice, may include an ice maker configured to generate and supply ice.

Although a few embodiments of the present disclosure have been shown and described, it would be appreciated by those skilled in the art that changes may be made in these embodiments without departing from the principles and spirit of the disclosure, the scope of which is defined in the claims and their equivalents.

What is claimed is:

1. A refrigerator comprising:

a body provided with a storage compartment having a front side opening;

a door rotatably coupled by a coupling member to one side of the body to open/close the front side opening of the storage compartment; and at least one door pocket coupled to an inner side of the door in a way to have a storage space and provided with a first side surface and a second side surface, the second side surface provided at a side facing the storage compartment and the first side surface connected to the second side surface to be positioned adjacent to a side of the door that is open, wherein a height of the second side surface is higher than a height of the first side surface to prevent cool air of the storage compartment from leaking to an outside, and stored goods positioned in the storage space can be withdrawn when the door is partially opened, wherein the at least one door pocket comprises a first pocket having the first side surface and the second side surface; and a second pocket disposed in parallel to the first pocket and positioned adjacent the coupling member, wherein the first pocket comprises a third side surface connected to the second side surface, and the third side surface is formed at a substantially same height as the second side surface to form a blocking surface that separates a storage space of the first pocket from the storage compartment.

2. The refrigerator of claim 1, wherein the at least one door pocket is provided in plurality thereof installed at the door in multiple steps, and a certain one of the first pockets of the plurality of door pockets has the second side surface connected to a bottom surface of another one of the first pockets of the plurality of door pockets that is positioned at an upper side of the certain one first pocket.

3. The refrigerator of claim 2, wherein the blocking surface comprises at least one ventilating port.

4. The refrigerator of claim 1, wherein the first pocket comprises a water purifier provided with a water container and a water supplying unit.

5. The refrigerator of claim 4, wherein an upper portion of the water supplying unit comprises an opening configured to receive water from the water container;

the water container is provided in a way to be detached from the first pocket; and a cover unit to cover the opening unit is provided so that a space at which the water container has been positioned is used as a shelf.

6. The refrigerator of claim 1, wherein the first pocket and the second pocket are insertedly fixed to the door.

7. The refrigerator of claim 1, wherein the second pocket comprises a receiving case configured to store storage goods in a closed space.

8. The refrigerator of claim 7, further comprising:

a receiving door rotatably installed at one side of the receiving case to form a closed space.

9. The refrigerator of claim 1, wherein the first pocket comprises an ice storage container.

10. The refrigerator of claim 1, wherein the first pocket comprises an ice maker configured to generate and supply ice.

11. The refrigerator of claim 1, wherein the coupling member comprises a double hinge so that the door is rotated to expose the first pocket to an outside and that the door is rotated again to expose the storage compartment to an outside.

12. A refrigerator comprising:

a body provided with a storage compartment at an inside thereof;

a door having a first side configured to be separated from the body and allowing the storage compartment to be exposed to an outside and a second side positioned at an opposite side of the first side and rotatably coupled to the body; and a plurality of door pockets coupled to an inner side of the door in multiple steps while being connected from the first side to the second side, wherein the plurality of door pockets comprise a first pocket positioned adjacent to the first side and a second pocket positioned adjacent to the second side, the first pocket protruding toward the storage compartment by a width larger than a width by which the second pocket protrudes toward the storage compartment, wherein the first pocket comprises a first side surface positioned adjacent to the first side so as to be coupled to the door, a second side surface connected to the first side surface and formed at a side facing the storage compartment, and a third side surface connected to the second side surface and positioned adjacent to the second pocket, and wherein a height of the second side surface and a height of the third side surface are higher than a height of the first side surface so that cool air of the storage compartment is prevented from leaking to an outside.

13. The refrigerator of claim 12, wherein the first side surface is provided in a curved shape so that the first side surface is exposed to an outside without restriction according to rotation of the door.

14. The refrigerator of claim 12, wherein one of the first pockets of the plurality of door pockets that is provided at a highest position of the door has the second side surface and the third side surface formed to an upper surface of the storage compartment.

15. The refrigerator of claim 12, further comprising:

a shelf and a storage container that are provided at an inside the storage compartment, wherein so as to correspond to a shape of the plurality of door pockets, one side of each of the shelf and the storage container facing the first pocket has a width smaller than a width of another side of each of the shelf and the storage container facing the second pocket.

16. A door pocket of a refrigerator that is fixed to an inner side surface of a door to store storage goods, the door pocket comprising:

a first pocket positioned adjacent to a first side of the door that is separated from a body as the door is rotated, and a second pocket positioned adjacent to a second side of the door that is coupled to the body, the first pocket protrudes from an inner side surface of the door by a width larger than a width by which the second pocket protrudes from the inner side surface of the door so as to have a storage space which is accessible when the door is partially open, the first pocket comprises a first side surface positioned adjacent to the first side so as to be coupled to the door, a second side surface connected to the first side surface and formed at a side facing a storage compartment, and a third side surface connected to the second side surface and positioned adjacent to the second pocket, and a height of the second side surface and a height of the third side surface are higher than a height of the first side surface so that cool air of the storage compartment is prevented from leaking to an outside.

17. The door pocket of the refrigerator of claim 16, wherein:

the storage space is configured to withdraw goods stored in the storage space even when the door is partially open.

* * * * *